United States Patent [19]

Bomes et al.

[11] Patent Number: 5,054,589

[45] Date of Patent: Oct. 8, 1991

[54] LUGGAGE WITH MOVABLE PARTITION

[75] Inventors: Harvey J. Bomes; Jack L. Barber, both of Baltimore, Md.

[73] Assignee: The Baltimore Luggage Company, Baltimore, Md.

[21] Appl. No.: 581,054

[22] Filed: Sep. 12, 1990

[51] Int. Cl.[5] ..... A45C 5/14; A45C 13/02; A45C 5/12

[52] U.S. Cl. ..... 190/18 A; 190/110; 190/111; 190/112; 190/113

[58] Field of Search ..... 190/18 A, 103, 111, 190/110, 112, 113; 224/209

[56] References Cited

U.S. PATENT DOCUMENTS

| | | | |
|---|---|---|---|
| 786,312 | 4/1905 | Pike | 190/111 |
| 2,131,583 | 9/1938 | Crotty et al. | 190/111 X |
| 2,536,169 | 1/1951 | Gray | 190/110 X |
| 2,705,063 | 3/1955 | Torrent | 190/111 |
| 2,918,997 | 12/1959 | Kotkins | 190/113 X |
| 2,964,149 | 12/1960 | Smallberg | 190/111 |
| 3,175,658 | 3/1965 | Bierman | 190/110 |
| 4,008,790 | 2/1977 | Eiteljorg, II | 190/111 X |
| 4,693,368 | 9/1987 | King et al. | 190/112 X |
| 4,925,021 | 5/1990 | Pulichino, Jr. | 190/112 X |
| 4,941,603 | 7/1990 | Creamer et al. | 190/111 X |

FOREIGN PATENT DOCUMENTS

| | | | |
|---|---|---|---|
| 3528862 | 2/1987 | Fed. Rep. of Germany | 190/110 |
| 644678 | 9/1962 | Italy | 190/111 |
| 70732 | 7/1946 | Norway | 224/209 |
| 2018580 | 10/1979 | United Kingdom | 190/103 |

*Primary Examiner*—Sue A. Weaver
*Attorney, Agent, or Firm*—Breiner & Breiner

[57] ABSTRACT

A luggage case comprises a luggage frame which is substantially continuous and centrally located so as to support the top, bottom, and end walls of the luggage, which has two flexible side walls provided with a zipper opening and closing means, and a flexible center partition which is removable and adapted to provide either two separate, individually accessible compartments for the luggage case or a single compartment accessible through one of the side wall openings.

5 Claims, 3 Drawing Sheets

LUGGAGE WITH MOVABLE PARTITION

FIELD OF THE INVENTION

This invention relates to luggage. More specifically, the invention relates to a luggage case which is adapted to be convertible from a two section luggage case to a one compartment luggage case. Thus, the luggage case of the invention may have either two separate, individually accessible compartments or one compartment for the carrying of articles of clothing and the like.

BACKGROUND OF THE INVENTION

Various types of luggage cases are known and available in the marketplace. For example, luggage cases having a single means of access, usually top opening or centering opening luggage, are available to the traveler. Top opening luggage usually has one compartment for the storage of articles and center opening luggage usually has two compartments. The latter type of luggage does not include separate, individually accessible compartments.

Additionally, luggage cases having two separate, individually accessible compartments are known such as disclosed in U.S. Pat. Nos. 2,918,997 and 2,964,149. In the disclosed luggage case, the two separate compartments are separated by a permanent center partition.

Each of the above single and dual access luggage cases have their advantages and have proved satisfactory to travelers. Thus, in some instances, a traveler may require a dual access, multiple compartment luggage case in order to separate his or her suits from articles such as shirts, undergarments, toiletries, and the like. In other instances, a single access, unitary compartment luggage case is desired by the traveler when clothing such as suits, overcoats, and the like are not being carried and/or when entry from one opening is desired for easy and quick access to the contents of the luggage case.

Up until the present invention, the traveler has been required to select from either a single access luggage case having a top or center opening or a dual access, multiple compartment luggage case depending on the specific nature of travel. However, due to the different reasons for traveling, the traveler may have needs for each style of luggage at different times. Such differing needs create a dilemma for the traveler as to which type of luggage case to purchase or whether to incur the expense of purchasing each type of case. The present invention solves this dilemma in providing a luggage case which may be converted from a dual access, multiple compartment luggage case to a single access luggage case or vice-versa depending on the traveler's needs.

PRIMARY OBJECTS AND SUMMARY OF THE INVENTION

It is a primary object of the present invention to provide a luggage case which, at the traveler's option, has either two separate, individually accessible compartments or one compartment accessible through one opening.

It is a further primary object of the invention to provide a luggage case having a flexible center partition which separates the luggage case into two separate, individually accessible compartments or which, at the option of the traveler, is partially or wholly removable to provide for one compartment accessible through one opening.

It is a further object of the present invention to provide a luggage case as described which is durable, attractive in appearance, simple in design and manufacture, and, most importantly, easy to use by the traveler.

The luggage case of the present invention comprises a luggage frame which is substantially continuous and centrally located so as to support top, bottom, and end walls of the luggage case to define an enclosure, which has two flexible side walls provided with a zipper opening and closing means for access to the enclosure, and a flexible center partition which is partially or fully removable and adapted to provide either two separate, individually accessible compartments for the luggage case or one compartment accessible through one of the side wall openings.

Other objects and advantages of the invention will become apparent from the drawing and description of the invention.

DESCRIPTION OF THE PRESENTLY PREFERRED EMBODIMENT

Figure 1:
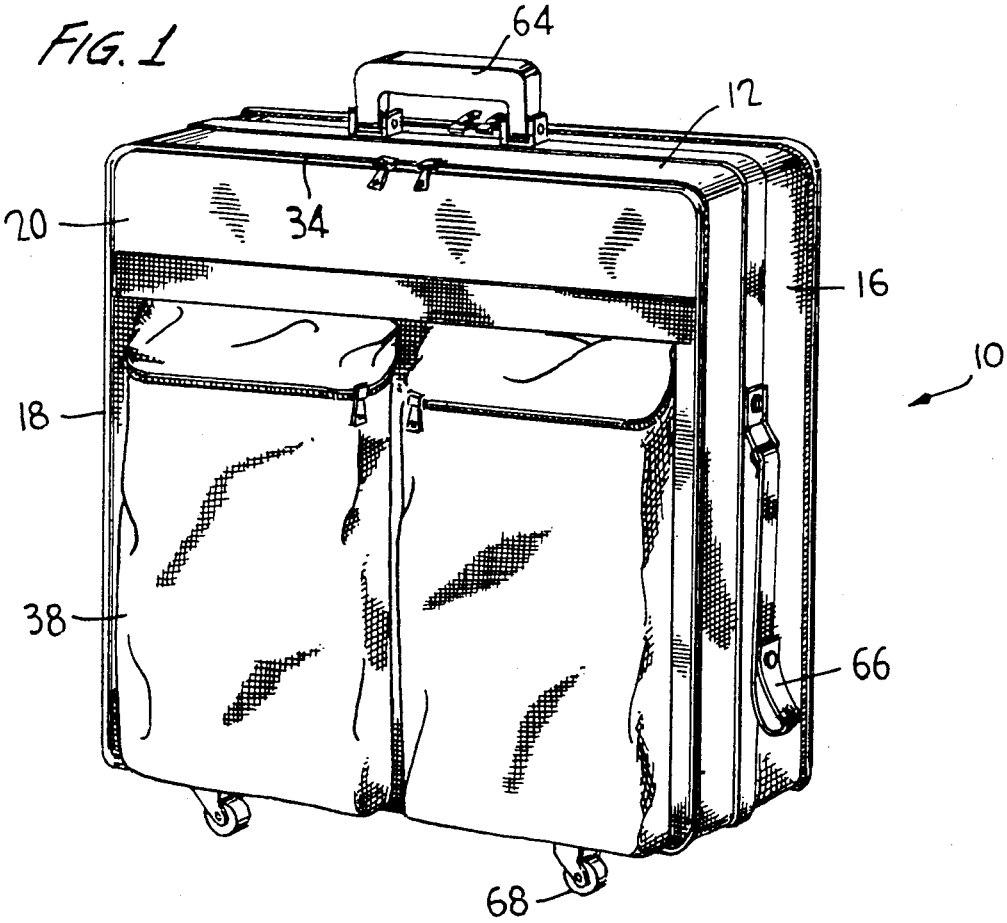
FIG. 1 is a perspective view of one side of the luggage construction according to the present invention.
Figure 2:
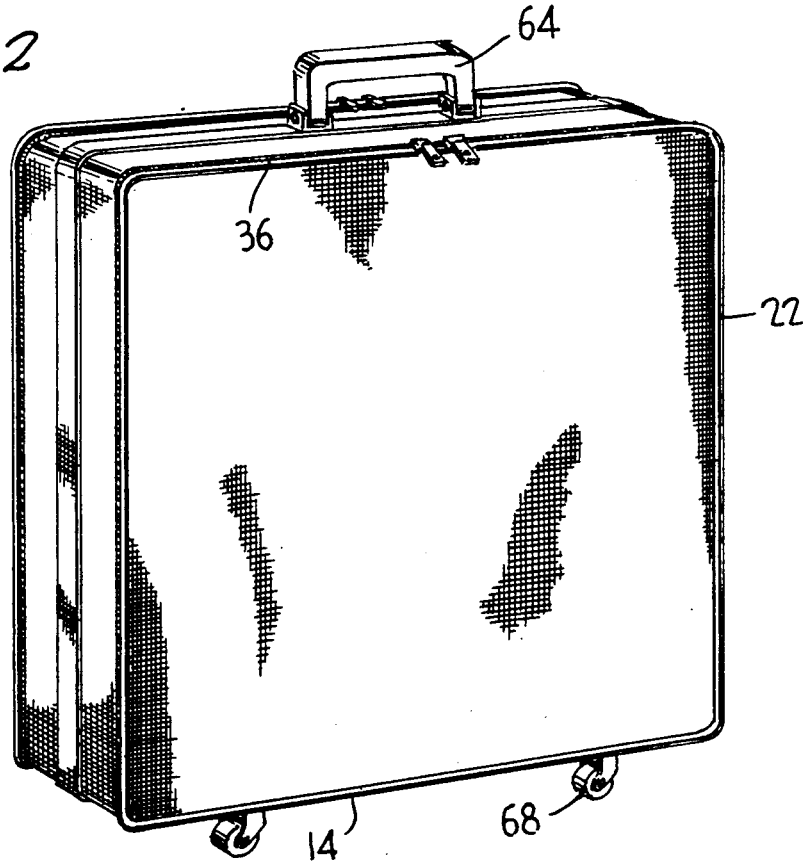
FIG. 2 is a perspective view of the luggage construction of the invention showing the side wall opposite that of FIG. 1.

The luggage case 10 of the present invention is directed to a luggage case which may have either two separate, individually accessible compartments or, at the option of the traveler, one compartment accessible through one side wall opening. The luggage case 10 generally includes top wall 12, bottom wall 14, end walls 16 and 18, and side walls 20 and 22. The luggage defines an enclosure for the storage of articles of clothing or the like in travel.

The luggage includes a frame comprised, in its presently preferred embodiment, of two substantially continuous and centrally located steel frames 24 and 26. The frames provide shape to the luggage, strength to the luggage and means for attachment of the various luggage hardware as described hereafter. The luggage frame is covered with a durable flexible plastic material such as nylon, polyvinyl chloride, or like materials. The presently preferred material is nylon with a polyvinyl chloride backing.

In the preferred embodiment, the top wall 12, bottom wall 14, and end walls 16 and 18 are fabricated as two sections 28 and 30. Section 28 is fastened to steel frame 24 and section 30 is fastened to the steel frame 26. Sections 28 and 30 are joined together by stitching 32. Side walls 20 and 22 are attached to sections 28 and 30 respectively at the bottom wall 14 by any suitable means such as stitching or the like. Attached to each of sections 28 and 30 and side walls 20 and 22 are zipper fastenings means 34 and 36. The zipper means 34 and 36 allow side walls 20 and 22 to open fully for easy access to the luggage enclosure.

Figure 3:
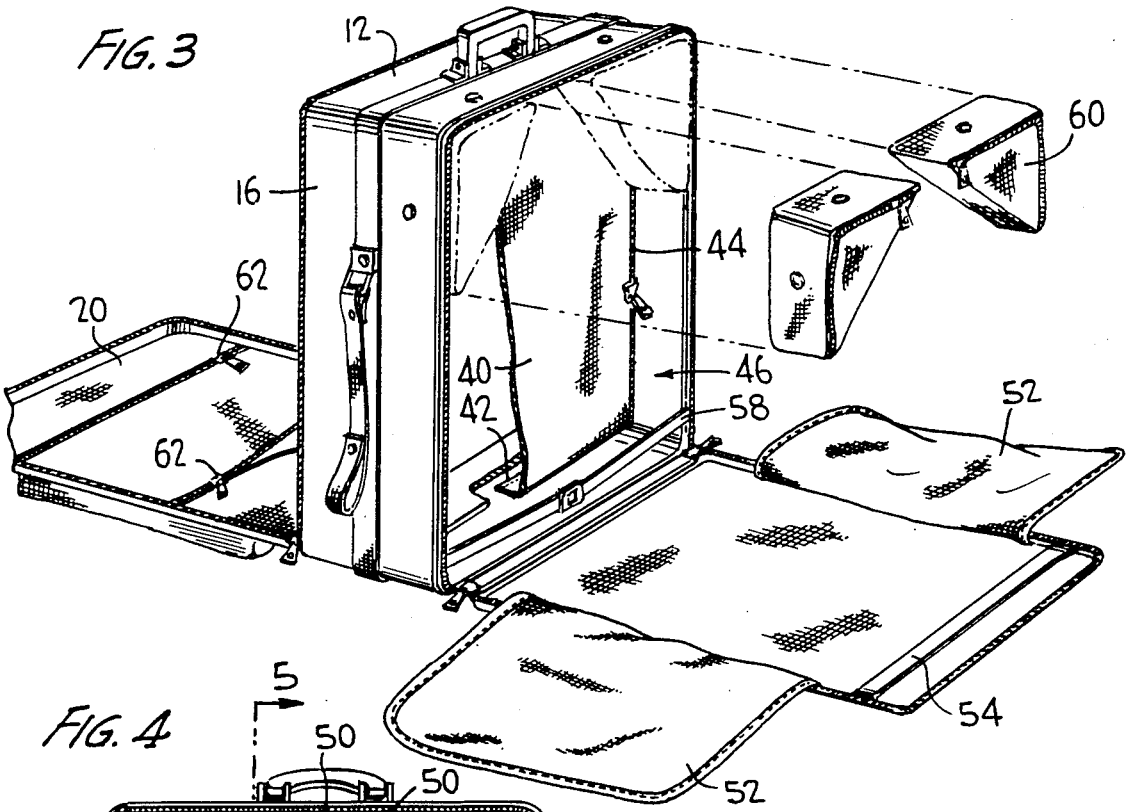
FIG. 3 is a view of the luggage construction of the invention with the side walls open showing the partition in partial cross-section.
Figure 6:
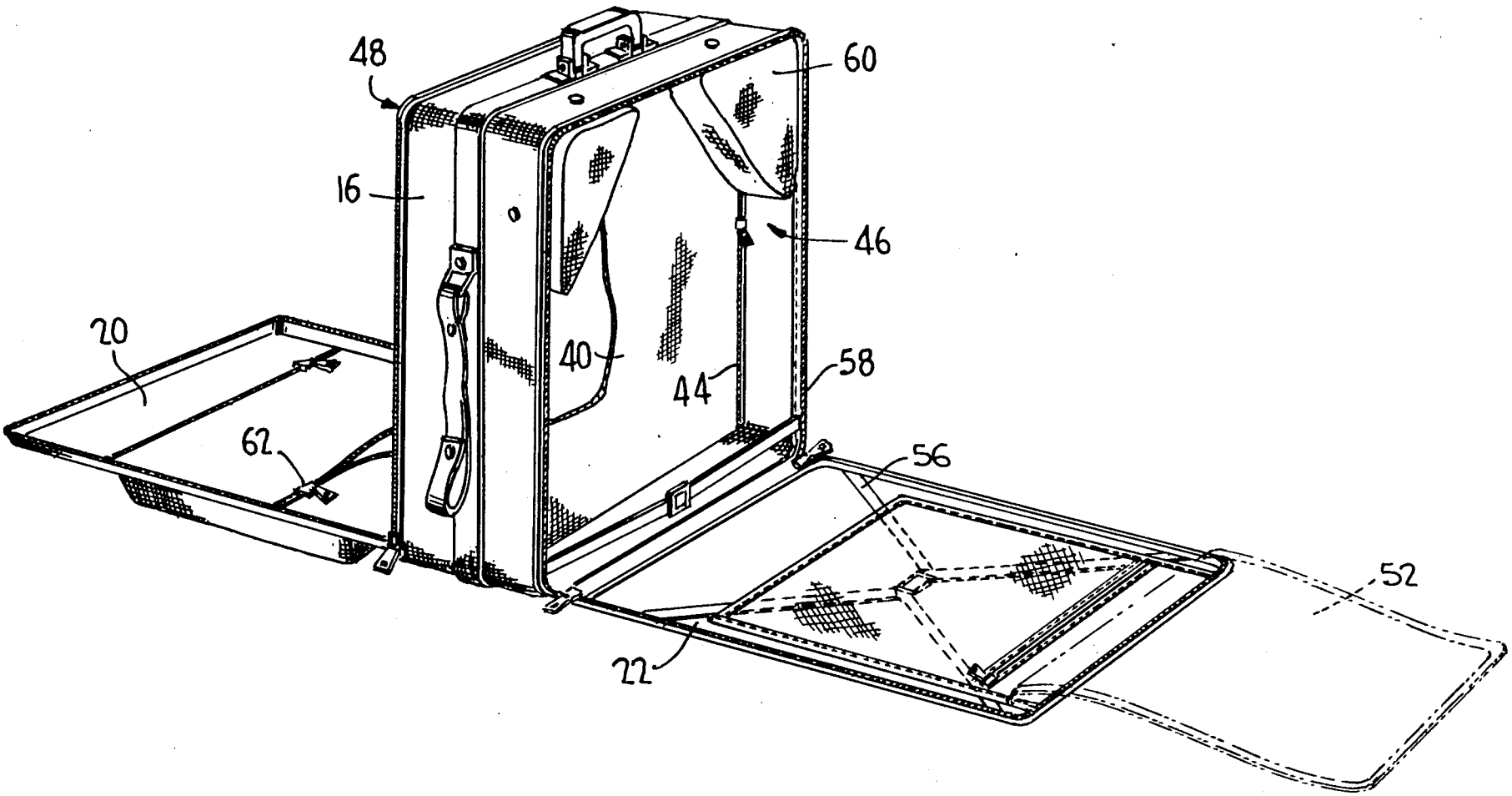
FIG. 6 is a view of the luggage construction of the invention with the side walls open similar to FIG. 3 showing the preferred embodiment of the retaining flap.

A flexible partition 40 is located generally centrally in luggage case 10. The partition 40 is a flexible plastic material, such as nylon. The partition 40 is attached by stitching 42 to bottom wall 14 and a zipper fastening means 44 which extend around the inner periphery of the end walls 16 and 18 and top wall 12. Zipper 44 renders partition 40 partially removable at the option of the traveler. Thus when the zipper is in the closed position as shown in FIGS. 3 and 6, partition 40 provides for two separate compartments which are separately accessible through side walls 20 and 22. When zipper 44 is open (not shown), the partition 40 may be laid flat on either of the inside of side walls 20 and 22 and one compartment will be obtained which is accessible through either of side wall openings 20 or 22. It is understood that partition 40 may be fully removable by extending the zipper means 44 also along bottom wall 14.

Figure 4:
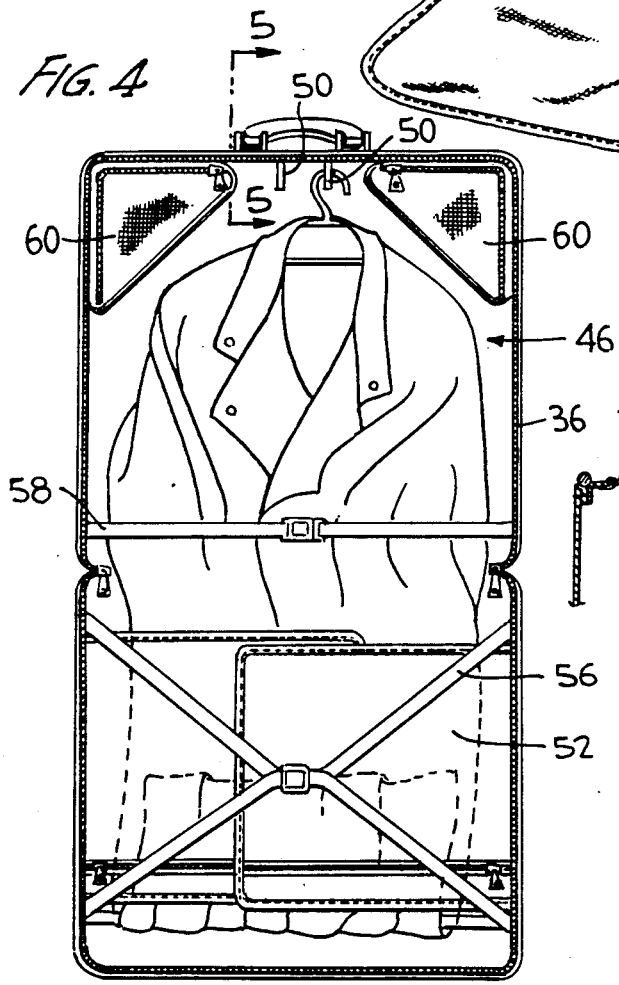
FIG. 4 is a side elevational view of the luggage construction of the invention showing one compartment of the luggage case when open.
Figure 5:
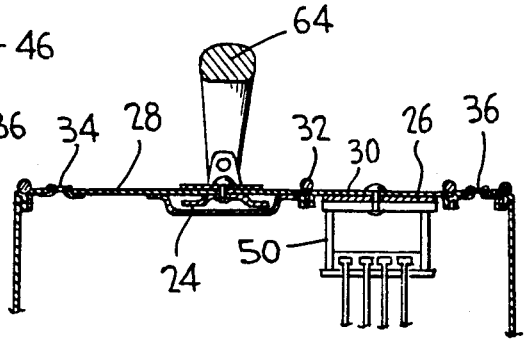
FIG. 5 is a partial cross-sectional horizontal view of the top wall of the luggage of the invention taken along line 5—5 of FIG. 4.

When partition 40 is in place as shown in FIGS. 3, 4, and 6, first and second compartments 46 and 48 are provided. Compartment 46 includes two universal hanger means 50 for carrying hangers to hold suits, dresses, overcoats, and the like. In order that the hanging garment remains pressed, single (FIG. 6) or multiple (FIGS. 3 and 4) retaining flaps 52 are provided for covering the garment. The presently preferred embodiment of the invention is shown at FIG. 6 showing a single retaining flap 52. Specifically, when the garment is an overcoat or the like of extended length, it may be placed under and folded over keeper bar 54 with retaining flaps 52 placed over the garment to maintain its pressed condition as shown in FIG. 4. Retaining flap 52 includes a zippered compartment for separately packing items such as ties or the like. The retaining flap 52 is made having a solid nylon backing with a mesh front to provide for breathing and visual inspection of the stored articles.

Additionally, retaining straps 56 and 58 are provided to further neatly retain the garments in a place.

Zippered storage pockets 60 are provided in the upper corners of compartment 46 for retaining small articles such as handkerchiefs, cufflinks, toiletries and similar small items. In the preferred embodiment, pockets 60 are removable as shown in FIG. 3 and are retained by snaps, velcro or other suitable attachment means. Pockets 60 are made of solid nylon backing with a mesh front.

Compartment 48 (not shown) is an open compartment for packing folded items such as shirts, pants, undergarments, and the like. The inside wall of side wall 20 includes zippered pockets 62 for separately retaining articles.

The outer wall of side wall 20 includes zipper pockets 38 for carrying articles separate from the inner compartment(s) of luggage case 10. Additional hardware for the luggage case includes handle 64 which is attached by means of rivets or the like to frame 24; pull leash 66 which is also attached to the frame 24 by rivet means or the like, and wheels 68 which are attached to bottom wall 14.

As seen from the above description, it will be apparent that the luggage of the present invention provides for a new and novel partition means which provides for a luggage case having two separate, individually accessible compartments or one compartment accessible through a single opening depending upon the needs of the traveler. The luggage of the present invention provides for a durable, light weight, and attractive luggage case. The simple design allows for ease in manufacture and provides a user-friendly luggage case.

It will be apparent that various modifications of the luggage of the present invention may be made by one skilled in the art without departing from the spirit and scope of the invention as set forth in the appended claims.

It is claimed:

1. A luggage case comprising a luggage frame covered with a lightweight material and having a top wall, bottom wall, end walls, and side walls defining an enclosure, said side walls being connectively attached to said top, bottom, and end walls by a fastening means which allows each of said side walls to open for access to the enclosure of said luggage case wherein the improvement comprises a flexible partition extending longitudinally from said top nd bottom walls and spaced inwardly from each of said side walls, said partition being fastened by stitching means to said bottom wall and being removably fastened to said top and end walls by a zipper means such that when in the unfastened position said partition will overlie one of said side walls for ease of packing whereby said luggage case may be converted to have two separate compartments each accessible from one side only or one compartment accessible from each side.

2. A luggage case according to claim 1 wherein when said partition is fastened to said top and end walls, said luggage case includes a first individually accessible compartment having a hanger means for hanging garments and a second individually accessible compartment for storage of articles separate from said first compartment.

3. A luggage case according to claim 2 wherein when said first compartment includes removably attached triangular corner pockets for separate storage of traveling articles.

4. A luggage case according to claim 1 wherein said luggage case includes wheels and a pull strap.

5. A luggage case according to claim 1 wherein said side walls are substantially flush with said top, bottom, and end walls.

* * * * *